US005528727A

United States Patent [19]

Wang

[11] Patent Number: 5,528,727

[45] Date of Patent: Jun. 18, 1996

[54] ADAPTIVE PITCH PULSE ENHANCER AND METHOD FOR USE IN A CODEBOOK EXCITED LINEAR PREDICTON (CELP) SEARCH LOOP

[75] Inventor: Yi-Sheng Wang, N. Potomac, Md.

[73] Assignee: Hughes Electronics, Los Angeles, Calif.

[21] Appl. No.: 434,096

[22] Filed: May 3, 1995

Related U.S. Application Data

[63] Continuation of Ser. No. 970,447, Nov. 2, 1992, abandoned.

[51] Int. Cl.[6] ..... G10L 9/00

[52] U.S. Cl. ..... 395/2.32; 395/229; 395/2.3; 395/2.17; 395/273

[58] Field of Search ..... 395/2, 2.1, 2.17, 395/2.28–2.32, 2.67, 2.71, .73; 381/36, 38

[56] References Cited

U.S. PATENT DOCUMENTS

| | | | |
|---|---|---|---|
| 5,060,269 | 10/1991 | Zinser | 381/38 |
| 5,138,661 | 8/1992 | Zinser et al. | 381/35 |
| 5,233,660 | 8/1993 | Chen | 395/2.28 |
| 5,295,224 | 3/1994 | Makamura et al. | 395/2.28 |
| 5,327,520 | 7/1994 | Chen | 95/2.31 |

FOREIGN PATENT DOCUMENTS 0296764 12/1988 European Pat. Off. .

OTHER PUBLICATIONS

Copper, "Efficient Excitation Modeling in a Low Bit–Rate Celp Coder," IEEE/ICASSP, 14–17 May 1991, pp. 233–236.

Taniguchi et al., "Pitch Sharpening for Perceptually Improved Celp, and the Sparse–Delta Codebook for Reduced Computation." IEEE/ICASSP, 14–17 May 1991, pp. 241–244.

ICASSP–92, vol. 1, 23 May 1992, San Francisco, pp. 65–68, Z. Xiongwei et al., "A new excitation model for LPC vocoder at 2.4 Kb/s".

Electronics & Communication Journal, vol. 4, No. 5, Oct. 1992, London, pp. 273–283, I. Boyd, "Speech coding for telecommunications".

*Primary Examiner*—Allen R. MacDonald
*Assistant Examiner*—Michael A. Sartori
*Attorney, Agent, or Firm*—Gordon R. Lindeen, III; Wanda K. Denson-Low

[57] ABSTRACT

An adaptive pitch pulse enhancer and method, adaptive to a voicing measure of input speech, for modifying the adaptive codebook of a CELP search loop to enhance the pitch pulse structure of the adaptive codebook. The adaptive pitch pulse enhancer determines a voicing measure of an input signal, the voicing measure being voiced when the input signal includes voiced speech and the voicing measure being unvoiced when the input signal does not include voiced speech, modifies a total excitation vector produced by the CELP search loop in accordance with the voicing measure of the input signal, and updates the adaptive codebook of the CELP search loop by storing the modified total excitation vector in the adaptive codebook.

24 Claims, 5 Drawing Sheets

ADAPTIVE PITCH PULSE ENHANCER AND METHOD FOR USE IN A CODEBOOK EXCITED LINEAR PREDICTON (CELP) SEARCH LOOP

This is a continuation application Ser. No. 07/970,447, filed Nov. 2, 1992, now abandoned.

BACKGROUND OF THE INVENTION

1. Field of the Invention

The present invention relates to a codebook excited linear prediction (CELP) coder.

The invention has particular application in digital cellular networks but may also be advantageous in any telecommunications product line that employs low bit rate CELP voice coding.

2. Description of the Related Art

Cellular telecommunications systems in North America are rapidly evolving from their current analog frequency modulated form towards digital systems. Typically, such digital cellular communication systems use a CELP technique for low rate speech coding. The technique involves searching a table or codebook of excitation vectors for that vector which, when filtered through a linear predictive filter, produces an output sequence which is closest to the input sequence. This output sequence of synthesized speech codes occurs upon excitation of the input sequence which in turn occurs upon the introduction of the digital equivalent of analog speech.

While conventional CELP techniques hold the most promise for high quality at bit rates in the vicinity of 8.0 Kbps, the quality suffers at lower bit rates approaching 4.0 Kbps. In particular, because the adaptive codebook in the CELP search loop is quite "flat," i.e. has a restricted variety of adaptive codebook vectors, during unvoiced speech periods, the CELP search loop has difficulty in generating periodic pulses at the onset of voiced speech. Thus, there is often a lag in the time it takes for the adaptive codebook to converge to a pitch pulse structure sufficient to synthesize voiced speech. This typically results in the cutting off of speech, especially during short speech spurts.

SUMMARY OF THE INVENTION

The present invention provides an improved CELP search loop and method for use in a CELP coder. It provides a pitch pulse enhancer and method for use in a CELP search loop of a CELP coder that will enhance the pitch pulse structure of an adaptive codebook of the CELP search loop by speeding up the convergence of the adaptive codebook. This is in part because the pitch pulse enhancer is adaptive to a voicing measure of input speech. Additional advantages of the invention will be set forth in the description which follows.

In accordance with the invention as embodied and broadly described here, a CELP search loop for coding an input signal is provided comprising adaptive codebook means for storing a variable set of excitation vectors, fixed codebook means for storing a fixed set of excitation vectors, codebook searching means for searching the adaptive codebook to determine an optimal adaptive codebook excitation vector, and for searching the fixed codebook to determine an optimal fixed codebook excitation vector, total excitation vector producing means for producing a total excitation vector from the optimal adaptive codebook excitation vector and the optimal fixed codebook excitation vector, voicing measure determining means for determining a voicing measure of the input signal, the voicing measure being voiced when the input signal includes voiced speech and the voicing measure being unvoiced when the input signal does not include voiced speech, modifying means for modifying the total excitation vector in accordance with the voicing measure of the input signal, and updating means for updating the adaptive codebook means by storing the modified total excitation vector in the adaptive codebook means.

In accordance with another aspect of the invention as embodied and broadly described here, an adaptive pitch pulse enhancer for use in a CELP search loop is provided, the CELP search loop including an adaptive codebook having a variable set of excitation vectors stored therein, a fixed codebook having a fixed set of excitation vectors stored therein, an adaptive codebook search loop for searching the adaptive codebook to determine an optimal adaptive codebook excitation vector, and a fixed codebook search loop for searching the fixed codebook to determine an optimal fixed codebook excitation vector, the CELP search loop producing a total excitation vector from the optimal adaptive codebook excitation vector and the optimal fixed codebook excitation vector, and the adaptive pitch pulse enhancer comprising voicing measure determining means for determining a voicing measure of the input signal, the voicing measure being voiced when the input signal includes voiced speech and the voicing measure being unvoiced when the input signal does not include voiced speech, modifying means for modifying the total excitation vector in accordance with the voicing measure of the input signal, and updating means for updating the adaptive codebook by storing the modified total excitation vector in the adaptive codebook.

In accordance with yet another aspect of the invention as embodied and broadly described here, a method of coding an input signal using a CELP search loop is provided comprising the steps of storing a variable set of excitation vectors in an adaptive codebook, storing a fixed set of excitation vectors in a fixed codebook, searching the adaptive codebook to determine an optimal adaptive codebook excitation vector, searching the fixed codebook to determine an optimal fixed codebook excitation vector, producing a total excitation vector from the optimal adaptive codebook excitation vector and the optimal fixed codebook excitation vector, determining a voicing measure of the input signal, the voicing measure being voiced when the input signal includes voiced speech and the voicing measure being unvoiced when the input signal does not include voiced speech, modifying the total excitation vector in accordance with the voicing measure of the input signal, and updating the adaptive codebook by storing the modified total excitation vector in the adaptive codebook.

In accordance with still another aspect of the invention as embodied and broadly described here, in a CELP search loop including an adaptive codebook having a variable set of excitation vectors stored therein, a fixed codebook having a fixed set of excitation vectors stored therein, an adaptive codebook search loop for searching the adaptive codebook to determine an optimal adaptive codebook excitation vector, and a fixed codebook search loop for searching the fixed codebook to determine an optimal fixed codebook excitation vector, the CELP search loop producing a total excitation vector from the optimal adaptive codebook excitation vector and the optimal fixed codebook excitation vector, a method of enhancing the pitch pulse structure of the adaptive codebook is provided comprising the steps of determining a voicing measure of the input signal, the voicing measure being voiced when the input signal includes voiced speech and the voicing measure being unvoiced when the input signal does not include voiced speech, modifying the total excitation vector in accordance with the voicing measure of the input signal, and updating the adaptive codebook by storing the modified total excitation vector in the adaptive codebook.

BRIEF DESCRIPTION OF THE DRAWINGS

The accompanying drawings, which are incorporated in and constitute a part of the specification, illustrate a presently preferred embodiment of the invention and, together with the general description given above and the detailed description of the preferred embodiment given below, serve to explain the principles of the invention. In the drawings.

DESCRIPTION OF THE PREFERRED EMBODIMENT AND METHOD

Figure 1:
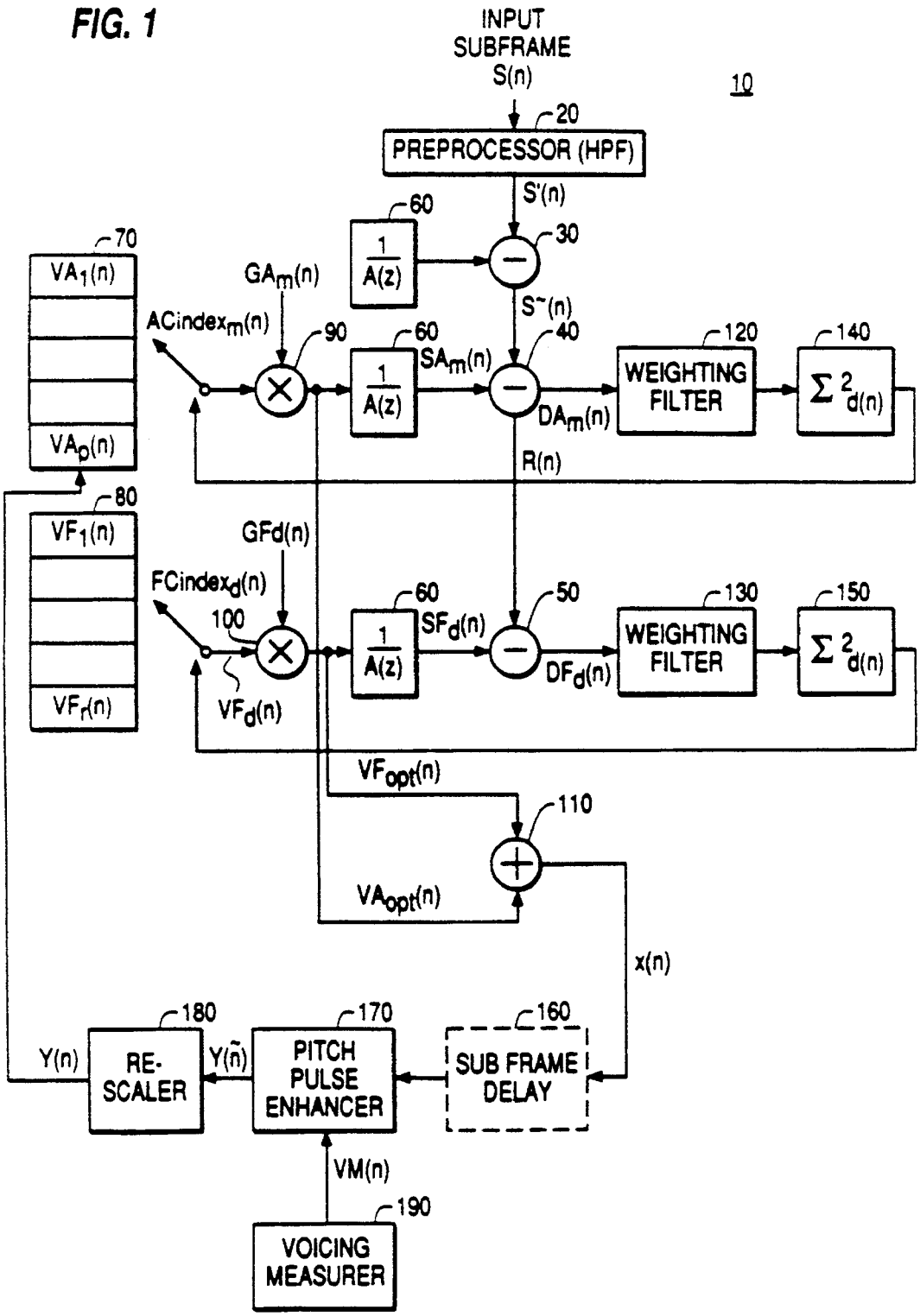
FIG. 1 illustrates a block diagram of a CELP search loop for use in a CELP coder in accordance with a preferred embodiment of the present invention.

Reference will now be made in detail to a presently preferred embodiment of the invention as illustrated in the accompanying drawings, in which like reference characters designate like or corresponding parts throughout the several drawings.

As shown in FIG. 1, there is provided a CELP search loop 10 incorporating the teachings of the present invention. CELP search loop 10 comprises a preprocessor 20, subtracters 30, 40 and 50, a linear prediction filter 60, an adaptive codebook 70, a fixed codebook 80, multipliers 90 and 100, an adder 110, weighting filters 120 and 130, summers 140 and 150, a subframe delay 160, a pitch pulse enhancer 170, a rescaler 180, and a voicing measurer 190.

Preferably, CELP search loop 10 of FIG. 1 comprises firmware which can be processed by a digital signal processor, such as the Texas Instrument TMS320C30, as is known to those skilled in the art. It should be understood that, although linear prediction filter 60 is shown in FIG. 1 as three separate functional blocks, linear prediction filter 60, preferably, comprises a single functional unit. It should also be understood that subframe delay 160 is a conceptual functional block only as is known to those skilled in the art and is, therefore, indicated by dashed lines.

Operation of CELP search loop 10 will now be described in detail with reference to the block diagram shown in FIG. 1 and flow diagram 1000 shown in FIGS. 3(*a*)–3(*b*). CELP search loop 10, preferably, operates on a subframe basis, that is, each pass of flow diagram 1000 is performed on a single subframe in a sequence of subframes of digitized data. Further, each subframe, preferably, comprises a block of 40 samples of an input analog speech signal.

Figure 3A:
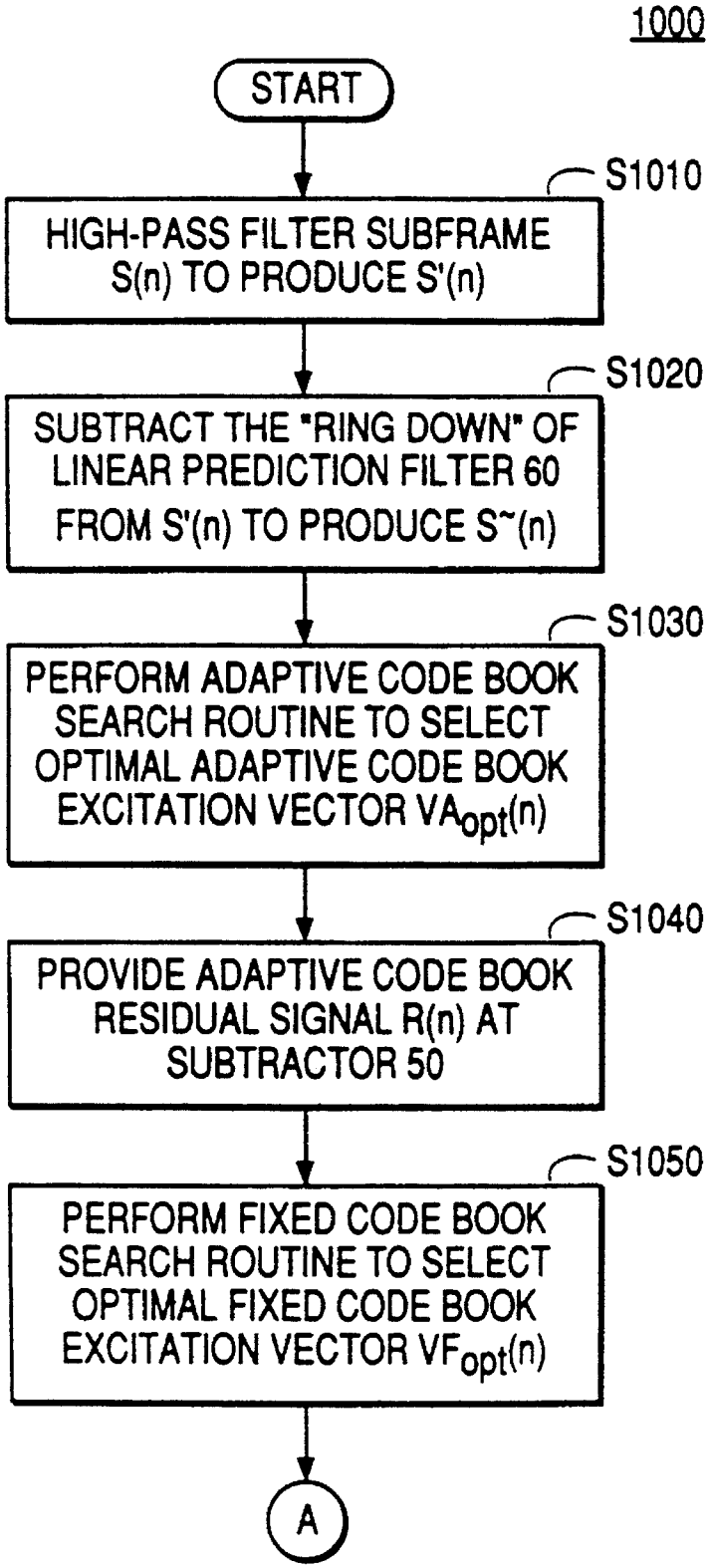
FIGS. 3(*a*)–3(*b*) illustrate an operation flow diagram of the CELP search loop of FIG. 1.
Figure 3B:
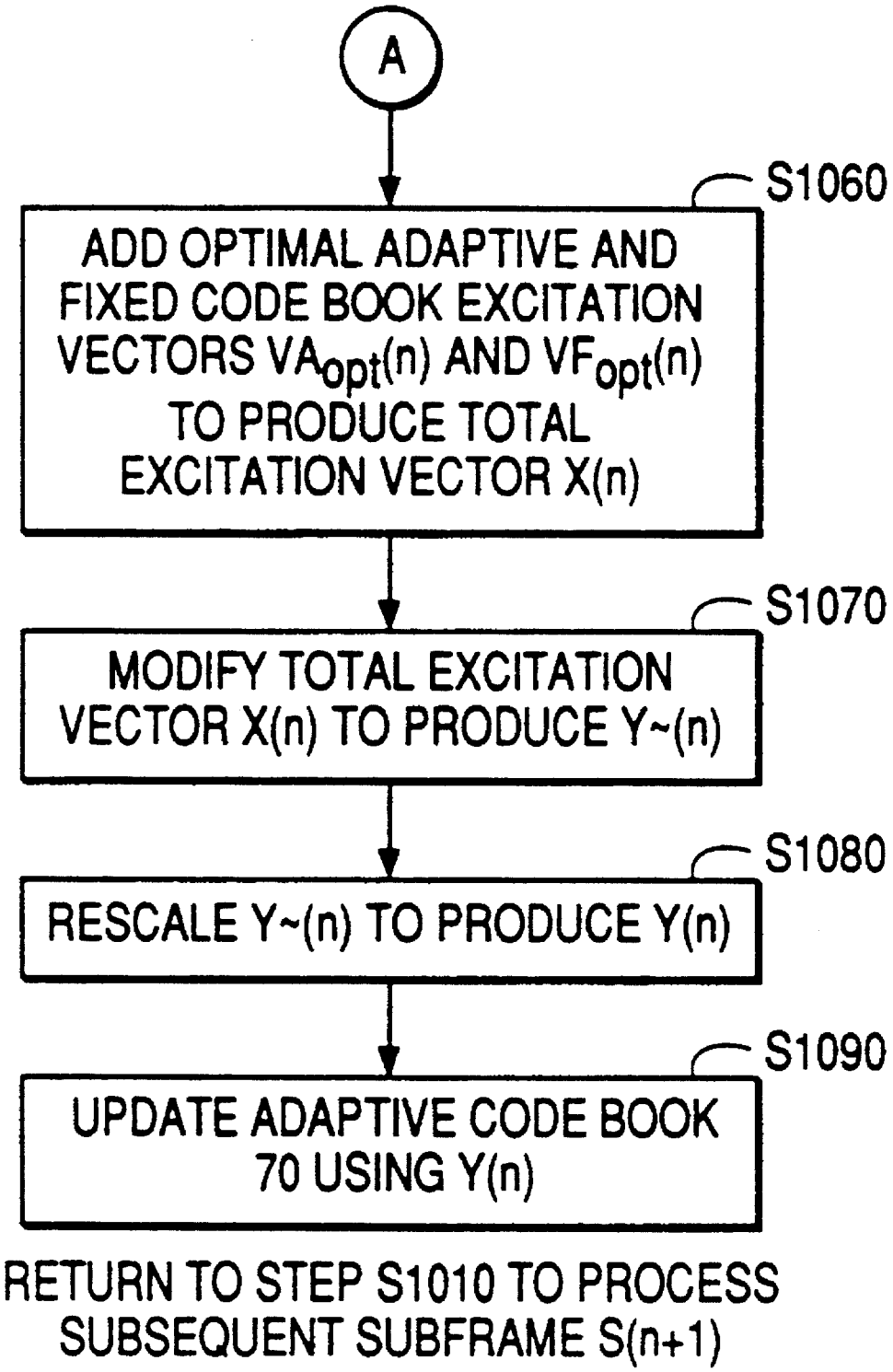

With reference to FIGS. 3(*a*)–3(*b*), in step S1010, an input digitized speech signal S(n), which is the nth subframe of digitized data in a sequence of n subframes, is preprocessed by preprocessor 20. Preferably, preprocessor 20 comprises a high pass filter for high pass filtering S(n) to produce S'(n), as is known to those skilled in the art. Control then passes to step S1020.

In step S1020, the "ring down," i.e., the zero-input response, of linear prediction filter 60 is subtracted from S'(n) to produce $S^{-}(n)$, as is known to those skilled in the art. Control then passes to step S1030.

In step S1030, an adaptive codebook search routine is performed, whereby the contents of adaptive codebook 70 are sequentially searched and analyzed to select an optimal adaptive codebook excitation vector which, when processed by linear prediction filter 60, most nearly resembles $S^{-}(n)$.

Specifically, adaptive codebook 70 comprises a table having p locations for storing a variable set of excitation vectors $VA_m(n)$, where m=1 through p and corresponds to a location in adaptive codebook 70. These excitation vectors are sequentially read out from adaptive codebook 70 in accordance with a corresponding adaptive codebook index $ACindex_m(n)$.

As each excitation vector $VA_m(n)$ is read out from adaptive codebook 70, it is multiplied by a corresponding gain $GA_m(n)$ at multiplier 90 and then applied to linear prediction filter 60. Linear prediction filter 60 comprises, for example, an all-pole filter which processes the incoming excitation vector into a synthesized speech signal $SA_m(n)$, as is known to those skilled in the art.

Next, synthesized speech signal $SA_m(n)$ is subtracted from $S^{-}(n)$ at subtracter 40 to produce a difference signal $DA_m(n)$. It should be understood that difference signal $DA_m(n)$ is an indication of how closely excitation vector $VA_m(n)$, when multiplied by gain $GA_m(n)$ and processed by linear prediction filter 60, resembles $S^{-}(n)$. In particular, the smaller the difference signal $DA_m(n)$, the closer the resemblance. This difference signal is then weighted by weighting filter 120 and summed over the length of the subframe S(n) by summer 140. The output of summer 140 is then used to vary adaptive codebook index $ACindex_m(n)$ to select the next excitation vector from adaptive codebook 70, as is also known to those skilled in the art.

The above adaptive codebook search routine continues until each of the vectors $VA_1(n)$ through $VA_p(n)$ is read from adaptive codebook 70, multiplied by a respective gain at multiplier 90, processed by linear prediction filter 60, and compared to $S^{-}(n)$. Upon completion of the adaptive codebook search routine, the optimal adaptive codebook excitation vector, i.e., that excitation vector $VA_1(n)$ through $VA_p(n)$ which, when multiplied by its respective gain and processed by linear prediction filter 60, most nearly resembles $S^{-}(n)$, is applied to adder 110. The optimal adaptive codebook excitation vector is found by comparing the difference signals produced at subtracter 40 for each excitation vector $VA_1(n)$ through $VA_p(n)$ and selecting the excitation vector which produces the smallest difference signal. As shown in FIG. 1, the optimal adaptive codebook excitation vector is designated as VAopt(n). Control then passes to step S1040.

In step S1040, an adaptive codebook residual signal, i.e., the difference signal produced by the subtraction of the synthesized speech signal corresponding to optimal adaptive codebook excitation vector $VA_{opt}(n)$ from $S^{-}(n)$ at subtracter 40, is provided at subtracter 50. As shown in FIG. 1, this residual signal is designated as R(n). Upon completion of step S1040, control passes to step S1050.

In step S1050, a fixed codebook search routine is performed, whereby the contents of fixed codebook 80 are sequentially searched and analyzed to select an optimal fixed codebook excitation vector which, when processed by linear prediction filter 60, most nearly resembles residual signal R(n). It should be evident from the following that the fixed codebook search routine is somewhat similar to the adaptive codebook search routine.

Specifically, fixed codebook 80 comprises a table having r locations for storing a fixed set of excitation vectors $VF_d(n)$, where d=1 through r and corresponds to a location in fixed codebook 80. These excitation vectors are sequentially read out from fixed codebook 80 in accordance with a corresponding fixed codebook index $FCindex_d(n)$.

As each vector $VF_d(n)$ is read out from fixed codebook 80, it is multiplied by a corresponding gain $GF_d(n)$ at multiplier 00 and then applied to linear prediction filter 60. As described above with regard to the adaptive codebook search routine, linear prediction filter 60 comprises, for example, an all-pole filter which processes the incoming excitation vector into a synthesized speech signal $SF_d(n)$, as is known to those skilled in the art.

Next, synthesized speech signal $SF_d(n)$ is subtracted from residual signal R(n) at subtracter 50 to produce a difference signal $DF_d(n)$. Again, as was the case with the adaptive codebook search routine, the difference signal $DF_d(n)$ is an indication of how closely excitation vector $VF_d(n)$, when multiplied by gain $GF_d(n)$ and processed by linear prediction filter 60, resembles residual signal R(n). This difference signal is then weighted by weighting filter 130 and summed over the length of subframe S(n) by summer 150. The output of summer 150 is then used to vary fixed codebook index $FCindex_d(n)$ to select the next excitation vector from fixed codebook 80, as is known to those skilled in the art.

The above fixed codebook search routine continues until each of the vectors $VF_1(n)$ through $VF_r(n)$ is read from fixed codebook 80, multiplied by a respective gain at multiplier 100, processed by linear prediction filter 60, and compared to residual signal R(n). Upon completion of the fixed codebook search routine, the optimal fixed codebook excitation vector, i.e., that excitation vector $VF_1(n)$ through $VF_r(n)$ which, when multiplied by its respective gain and processed by linear prediction filter 60, most nearly resembles residual signal R(n), is applied to adder 110. As explained above with regard to the adaptive codebook search routine, the optimal fixed codebook excitation vector is found by comparing the difference signals produced at subtracter 50 for each excitation vector $VF_1(n)$ through $VF_r(n)$ and selecting the excitation vector which produces the smallest difference signal. As shown in FIG. 1, the optimal fixed codebook excitation vector is designated as VFopt(n). Upon completion of step S1050, control passes to step S1060.

In step S1060, optimal adaptive and fixed codebook excitation vectors VAopt(n) and VFopt(n) are added together by adder 110 to produce total excitation vector X(n). Control then passes to step S1070.

In step S1070, total excitation vector X(n) is modified by pitch pulse enhancer 170 using a nonlinear function to produce $Y^{-}(n)$ as follows:

$$Y^{-}(n)=X(n)^{PEFACT} \tag{1.0}$$

where PEFACT is termed a pitch enhancement factor and is, preferably, a positive number greater than or equal to unity. As will be explained below, pitch enhancement factor PEFACT is adaptive to a voicing measure VM(n) determined by voicing measurer 190.

Step S1070 will now be described in detail with reference to the block diagram shown in FIG. 2 and the flow diagram 2000 shown in FIG. 4.

Figure 2:
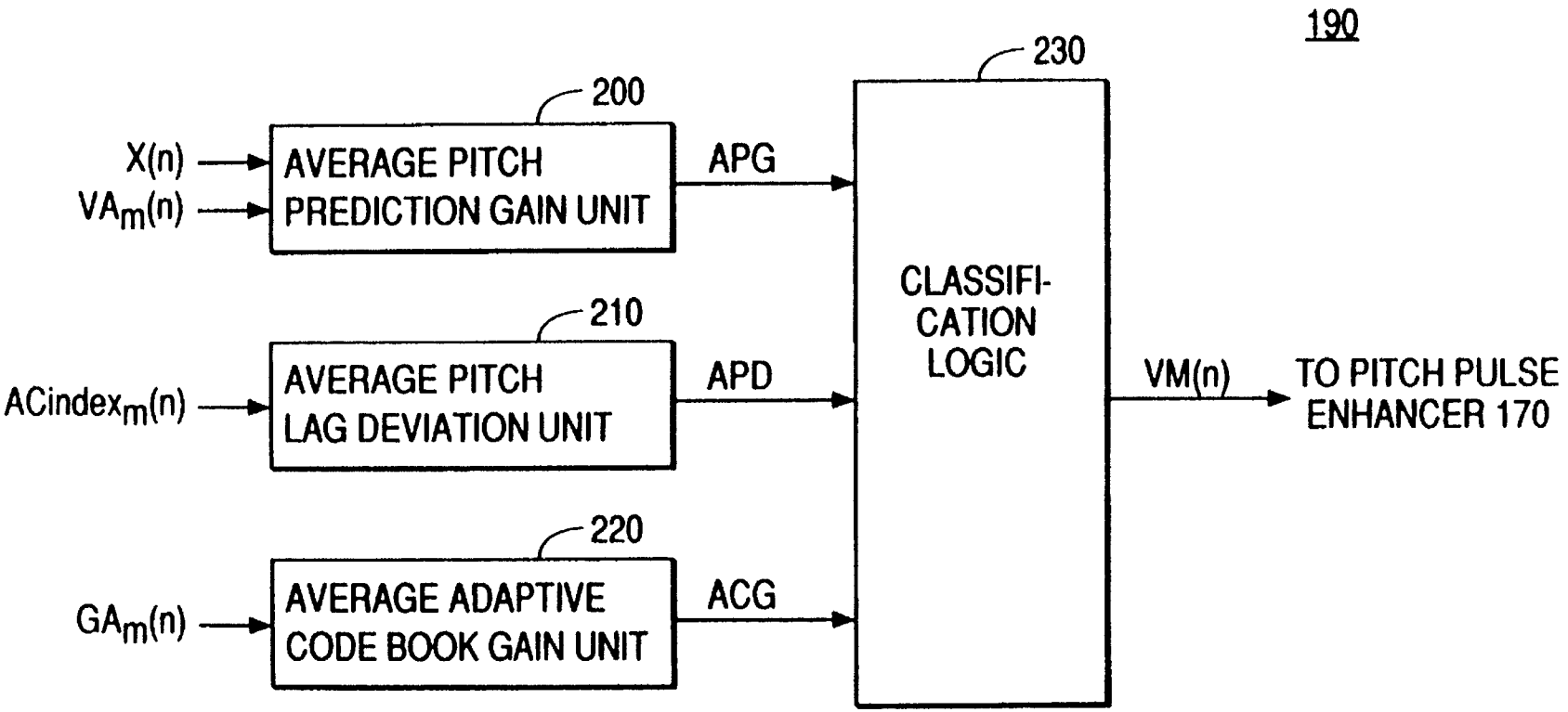
FIG. 2 illustrates a block diagram of the voicing measurer of the CELP search loop of FIG. 1.

As shown in FIG. 2, voicing measurer 190 of FIG. 1 comprises an average pitch prediction gain unit 200, an average pitch lag deviation unit 210, an average adaptive codebook gain unit 220, and classification logic 230.

Figure 4:
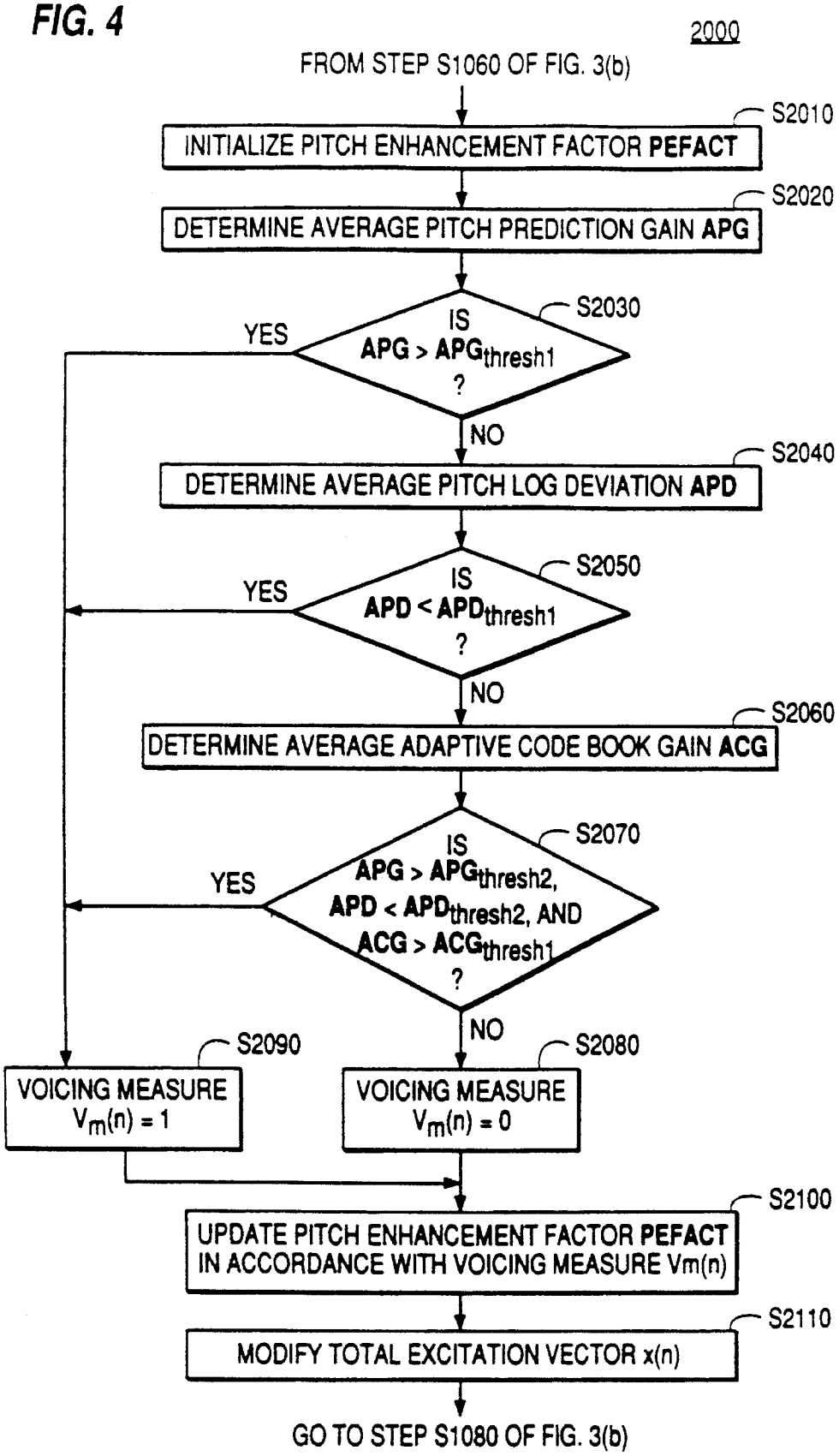
FIG. 4 illustrates an operation flow diagram of the pitch pulse enhancer and voicing measurer of FIG. 2.

With reference to FIG. 4, as will be explained below, in steps S2020, S2040 and S2060, average pitch prediction gain unit 200, average pitch lag deviation unit 210, and average adaptive codebook gain unit 220 determine various parameters. These parameters are compared to respective threshold values by classification logic 230 in steps S2030, S2050 and S2070, to determine voicing measure VM(n) of subframe S(n). It should be noted that voicing measure VM(n) indicates an absence (unvoiced; VM(n)=0) or presence (voiced; VM(n)=1) of voiced speech in subframe S(n).

In step 2010, voicing measurer 190 initializes pitch enhancement factor PEFACT. Preferably, pitch enhancement factor PEFACT is initialized such that it equals one. Control then passes to step S2020.

In step S2020, average pitch prediction gain unit 200 determines an average pitch prediction gain APG. In particular, average pitch prediction gain unit 200 receives as input signals total excitation vector X(n) and adaptive codebook excitation vector $VA_m(n)$ and determines a pitch prediction gain PG, as follows:

$$PG = 10\log_{10}\left[\sum_{n=0}^{N-1}(GA_m VA_m(n))^2 / \sum_{n=0}^{N-1} X^2(n)\right] \tag{Eqn. 2.0}$$

where N is the frame length of subframe S(n) and, as explained above preferably equals 40 samples. Then, average pitch prediction unit 200 determines average pitch prediction gain APG by averaging pitch prediction gain PG over M subframes, as follows:

$$APG = (1/M)\sum_{i=0}^{M} PG(i) \tag{Eqn. 3.0}$$

Preferably, M is equal to 5–10 subframes. Upon completion of step S2020, control passes to step S2030.

In step S2030, classification logic 230 compares average pitch prediction gain APG to a first pitch prediction gain threshold $APG_{thresh1}$. It should be understood that the value of $APG_{thresh1}$ depends on the application of the present invention and can be determined by one skilled in the art. If classification logic 230 determines that APG is greater than $APG_{thresh1}$, control passes to step S2090, wherein classification logic 230 sets voicing measure VM(n) equal to one (indicating that subframe S(n) is voiced) and control then passes to step S2100. Otherwise, control passes to step S2040.

In step S2040, average pitch lag deviation unit 210 determines an average pitch lag deviation APD. In particular, average pitch lag deviation unit 210 receives as an input signal adaptive codebook index $ACindex_m(n)$ and determines average pitch lag deviation APD, as follows:

$$APD = 1/M\sum_{i=1}^{M} NINT[d(i)] - d(i) \tag{Eqn. 4.0}$$

where M is, again, the number of subframes over which the average is taken, NINT is a nearest integer function and d(i) is determined as follows:

$$d(i) = \begin{cases} Acindex_m(i)/MACindex_m \\ \text{if } APD(i) \geqq MAPD \\ MACindex_m/ACindex_m(i) \text{ otherwise} \end{cases} \tag{Eqn. 4.2}$$

where $MACindex_m$=Median ($ACindex_m(i)$, i=1, 2, . . . , M). Upon completion of step S2040, control passes to step S2050.

In step S2050, classification logic 230 compares average pitch lag deviation APD to a first pitch lag threshold $APD_{thresh1}$. Again, it should be understood that the value of $APD_{thresh1}$ depends on the application of the present invention and can be determined by one skilled in the art. If classification logic 230 determines that APD is less than $APD_{thresh1}$, control passes to step S2090, wherein classification logic 230 sets voicing measure VM(n) equal to one (indicating that subframe S(n) is voiced) and control then passes to step S2100. Otherwise, control passes to step S2060.

In step S2060, average adaptive codebook gain unit 220 determines an average adaptive codebook gain ACG. In particular, average adaptive codebook gain unit 220 receives as an input signal adaptive codebook gain $G_M(n)$ and determines average adaptive codebook gain ACG, as follows:

$$AGC = (1/M) \sum_{i=0}^{M} GA_m(i) \qquad \text{Eqn. 5.0}$$

where, as explained above, M is the number of subframes over which the average is taken. Control then passes to step S2070.

In step S2070, classification logic 230 compares average pitch prediction gain to a second pitch prediction gain threshold $APG_{thresh2}$, compares average pitch lag deviation APD to a second pitch lag threshold $APD_{thresh2}$, and compares average adaptive codebook gain ACG to a first adaptive codebook gain threshold $ACG_{thresh1}$. Once again, it should be understood that the values of these thresholds depend on the application of the present invention and can be determined by one skilled in the art.

If classification logic 230 determines that APG is greater than $APG_{thresh2}$, that APD is less than $APD_{thresh2}$ and that ACG is greater than $ACG_{thresh1}$, then control passes to step S2090, wherein classification logic 230 sets voicing measure VM(n) equal to one (indicating that subframe S(n) is voiced) and control then passes to step S2100. Otherwise, control passes to step S2080.

In step S2080, classification logic 230 sets voicing measure VM(n) equal to zero. As explained above, this indicates that subframe S(n) is unvoiced. Control then passes to step S2100.

In step S2100, pitch pulse enhancer 170 updates pitch enhancement factor PEFACT in accordance with voicing measure VM(n), as follows:

$$\text{If } VM(n)=0, \text{ then } PEFACT=PEFACT^{(1.5)} \qquad (6.0)$$

$$\text{IF } VM(n)=1, \text{ then } PEFACT=PEFACT^{(0.93)} \qquad (6.2)$$

Preferably, PEFACT is clamped such that $1.05 \leqq PEFACT \leqq 1.18$. It should be understood that the above described values of PEFACT can be modified as appropriate to suit a particular application of the present invention as is known to those skilled in the art. Upon completion of step S2100, control passes to step S2110.

In step S2110, pitch pulse enhancer modifies total excitation vector X(n) to produce Y~(n) as shown above in Eqn. 1.0. Control then passes to step S1080 of FIG. 3(*b*).

It should be evident from the above description of voicing measurer 190 that the voicing measure of subframe S(n) is determined by using only synthesis parameters, thereby eliminating the need of explicitly transmitting voicing information to the synthesis side of CELP search loop 10.

Referring back to the block diagram of FIG. 1 and flow diagram 1000 of FIGS. 3(*a*)–3(*b*), in step S1080, rescaler 180 rescales Y~(n) to produce Y(n), as follows:

$$Y(n)=aY\sim(n) \qquad (7.0)$$

where $$\alpha = \left[ \sum_{n=0}^{N-1} X^2(n) / \sum_{n=0}^{N-1} Y^2(n) \right]^{1/2}.$$

Again, N is the length of subframe S(n). It should be understood that step S1080 is provided to maintain the energy level of total excitation vector X(n) in Y(n). In particular, step S1070 has the effect of altering the total energy level of total excitation vector X(n) and step S1080 serves to restore the total energy of Y~(n) to that level. Upon completion of step S1080, control passes to step S1090.

In step S1090, rescaler updates adaptive codebook 70 using Y(n). In particular, Y(n) is stored in adaptive codebook 70 as a new excitation vector for use in the processing of a subsequent input subframe, i.e., input signal S(n+1). Preferably, Y(n) is stored in the last location of adaptive codebook 70, i.e., location p, thereby shifting the excitation vectors stored in previous locations forward and causing that vector stored in the first location to be discarded. Upon completion of step S1090, control passes back to step S1010 wherein the entire process of FIGS. 3(*a*)–3(*b*) is performed on a subsequent input subframe S(n+1).

Additional advantages and modifications will readily occur to those skilled in the art. Therefore, the invention in its broader aspects is not limited to the specific details, representative devices, and illustrative examples shown and described. Accordingly, departures may be made from such details without departing from the spirit or scope of the general inventive concept as defined by the appended claims and their equivalents.

What is claimed is:

1. An encoder for coding an input signal, comprising:

adaptive codebook means for storing a variable set of excitation vectors;

fixed codebook means for storing a fixed set of excitation vectors;

codebook searching means for searching said adaptive codebook means to determine an optimal adaptive codebook excitation vector, and for searching said fixed codebook means to determine an optimal fixed codebook excitation vector;

total excitation vector producing means for producing a total excitation vector from said optimal adaptive codebook excitation vector and said optimal fixed codebook excitation vector;

voicing measure determining means for determining a voicing measure of said input signal, said voicing measure being voiced when said input signal includes voiced speech and said voicing measure being unvoiced when said input signal does not include voiced speech; and modifying means for modifying said total excitation vector by raising said total excitation vector to an exponent determined in accordance with said voicing measure of said input signal.

2. The encoder of claim 1, wherein said codebook searching means includes:

an adaptive codebook search means, said adaptive codebook search means having adaptive codebook indexing means for sequentially reading adaptive codebook excitation vectors from said adaptive codebook means, first linear prediction filter means for producing first synthetic speech signals from said read adaptive codebook excitation vectors, first subtracting means for subtracting each of said first synthetic speech signals from said input signal to produce corresponding first difference signals, and first comparing means for comparing said first difference signals to determine said optimal adaptive codebook excitation vector and a residual signal, wherein said residual signal is said first difference signal corresponding to said determined optimal adaptive codebook excitation vector; and a fixed codebook search means, said fixed codebook search means having fixed codebook indexing means for sequentially reading fixed codebook excitation vectors from said fixed codebook means, second linear prediction filter means for producing second synthetic speech signals from said read fixed codebook excitation vectors, second subtracting means for subtracting each of said second synthetic speech signals from said residual signal to produce corresponding second difference signals, and second comparing means for comparing said second difference signals to determine said optimal fixed codebook excitation vector.

3. The encoder of claim 1, wherein said total excitation vector producing means includes means for combining said optimal adaptive codebook excitation vector and said optimal fixed codebook excitation vector to produce said total excitation vector.

4. The encoder of claim 1, wherein said input signal comprises signal frames, which are partitioned into subframes, and said voicing measure determining means includes:

average pitch prediction gain determining means for determining an average pitch prediction gain for a signal frame of said input signal from a total excitation vector and an adaptive codebook excitation vector determined for each subframe of said input signal frame;

average pitch lag deviation determining means for determining an average adaptive pitch lag deviation for said signal frame from an index of said adaptive codebook means determined for each subframe of said signal frame;

average adaptive codebook gain determining means for determining an average adaptive codebook gain for said signal frame from an adaptive codebook gain for each subframe of said signal frame; and logic means for comparing said average pitch prediction gain, said average pitch lag deviation and said average adaptive codebook gain with respective threshold values to determine said voicing measure.

5. The encoder of claim 1, wherein said modifying means includes means for modifying said total excitation vector using a nonlinear function.

6. The encoder of claim 1, wherein said updating means includes rescaling means for rescaling said modified total excitation vector to maintain an energy level of said modified total excitation vector.

7. An adaptive pitch pulse enhancer for use in an encoder, the encoder including an adaptive codebook having a variable set of excitation vectors stored therein, a fixed codebook having a fixed set of excitation vectors stored therein, an adaptive codebook searching means for searching the adaptive codebook to determine an optimal adaptive codebook excitation vector, and a fixed codebook searching means for searching the fixed codebook to determine an optimal fixed codebook excitation vector, wherein said encoder produces a total excitation vector from the optimal adaptive codebook excitation vector and the optimal fixed codebook excitation vector, the adaptive pitch pulse enhancer comprising:

voicing measure determining means for determining a voicing measure of an input signal, said voicing measure being voiced when said input signal includes voiced speech and said voicing measure being unvoiced when said input signal does not include voiced speech; and modifying means for modifying said total excitation vector by raising said total excitation vector to an exponent determined in accordance with said voicing measure of said input signal.

8. The adaptive pitch pulse enhancer of claim 7, wherein said input signal comprises signal frames, which are partitioned into subframes, and wherein said voicing measure determining means includes:

average pitch prediction gain determining means for determining an average pitch prediction gain for a signal frame of said input signal from a total excitation vector and an adaptive codebook excitation vector determined for each subframe of said signal frame;

average pitch lag deviation determining means for determining an average adaptive pitch lag deviation for said signal frame from an index of said adaptive codebook determined for each subframe of said signal frame;

average adaptive codebook gain determining means for determining an average adaptive codebook gain for said signal frame from an adaptive codebook gain for each subframe of said signal frame; and logic means for comparing said average pitch prediction gain, said average pitch lag deviation and said average adaptive codebook gain with respective threshold values to determine said voicing measure.

9. The adaptive pitch pulse enhancer of claim 7, wherein said modifying means includes means for modifying said total excitation vector using a nonlinear function.

10. The adaptive pitch pulse enhancer of claim 7, wherein said updating means includes rescaling means for rescaling said modified total excitation vector to maintain an energy level of said modified total excitation vector.

11. A method of coding an input signal comprising the steps of:

storing a variable set of excitation vectors in an adaptive codebook;

storing a fixed set of excitation vectors in a fixed codebook;

searching said adaptive codebook to determine an optimal adaptive codebook excitation vector;

searching said fixed codebook to determine an optimal fixed codebook excitation vector;

producing a total excitation vector from said optimal adaptive codebook excitation vector and said optimal fixed codebook excitation vector;

determining a voicing measure of said input signal, said voicing measure being voiced when said input signal includes voiced speech and said voicing measure being unvoiced when said input signal does not include voiced speech; and modifying said total excitation vector by raising said total excitation vector to an exponent determined in accordance with said voicing measure of said input signal.

12. The method of claim 11, wherein said step of searching said adaptive codebook comprises the steps of:

sequentially reading each of said adaptive codebook excitation vectors from said adaptive codebook;

producing first synthetic speech signals from said read adaptive codebook excitation vectors;

subtracting each of said first synthetic speech signals from said input signal to produce corresponding first difference signals and comparing said first difference signals to determine said optimal adaptive codebook excitation vector and a residual signal, wherein said residual signal is said first difference signal corresponding to said optimal adaptive codebook excitation vector.

13. The method of claim 12, wherein said step of searching said fixed codebook further comprises the steps of:

sequentially reading each of said fixed codebook excitation vectors from said fixed codebook;

producing second synthetic speech signals from said read fixed codebook excitation signals;

subtracting each of said second synthetic speech signals from said residual signal to produce corresponding second difference signals; and comparing said second difference signals to determine said optimal fixed codebook excitation vector.

14. The method of claim 11, wherein said step of producing a total excitation vector includes the step of combining said optimal adaptive codebook excitation vector and said optimal fixed codebook excitation vector to produce said total excitation vector.

15. The method of claim 11, further comprising the steps of:

partitioning said input signal into signal frames, and further partitioning each signal frame into subframes; and wherein said step of determining a voicing measure includes the steps of:

determining an average pitch prediction gain for a signal frame of said input signal from a total excitation vector and an adaptive codebook excitation vector determined for each subframe of said signal frame;

determining an average pitch lag deviation for said signal frame from an index of said adaptive codebook determined for each subframe of said signal frame;

determining an average adaptive codebook gain for said signal frame from an adaptive codebook gain for each subframe of said signal frame; and comparing said average pitch prediction gain, said average pitch lag deviation and said average adaptive codebook gain with respective threshold values to determine said voicing measure.

16. The method of claim 11, wherein said step of modifying said total excitation vector includes the step of modifying said total excitation vector using a non-linear function.

17. The method of claim 11, wherein said step of updating includes rescaling said modified total excitation vector to maintain an energy level of said modified total excitation vector.

18. In an encoder including an adaptive codebook having a variable set of excitation vectors stored therein, a fixed codebook having a fixed set of excitation vectors stored therein, an adaptive codebook searching means for searching the adaptive codebook to determine an optimal adaptive codebook excitation vector, and a fixed codebook searching means for searching the fixed codebook to determine an optimal fixed codebook excitation vector, said encoder producing a total excitation vector from the optimal adaptive codebook excitation vector and the optimal fixed codebook excitation vector, a method of enhancing a pitch pulse structure of the adaptive codebook comprising the steps of:

determining a voicing measure of said input signal, said voicing measure being voiced when said input signal includes voiced speech and said voicing measure being unvoiced when said input signal does not include voiced speech; and modifying said total excitation vector by raising said total excitation vector to an exponent determined in accordance with said voicing measure of said input signal.

19. An encoder for coding an input signal, comprising:

a first memory for storing an adaptive codebook of a variable set of excitation vectors;

a second memory for storing a fixed codebook of a fixed set of excitation vectors;

a search processor in communication with said first and said second memories for searching said adaptive codebook to determine an optimal adaptive codebook excitation vector, for searching said fixed codebook to determine an optimal fixed codebook excitation vector, and for producing a total excitation vector from said optimal adaptive codebook excitation vector and said optimal fixed codebook excitation vector;

a voicing measurer for determining a voicing measure of said input signal, said voicing measure being voiced when said input signal includes voiced speech and said voicing measure being unvoiced when said input signal does not include voiced speech; and a filter in communication with said voicing measurer for modifying said total excitation vector by raising said total excitation vector to an exponent determined in accordance with said voicing measure of said input signal.

20. The encoder of claim 19, wherein said search processor includes:

an adaptive codebook searcher for:

sequentially reading adaptive codebook excitation vectors from said adaptive codebook, producing first synthetic speech signals from said read adaptive codebook excitation vectors, subtracting each of said first synthetic speech signals from said input signal to produce corresponding first difference signals, and comparing said first difference signals to determine said optimal adaptive codebook excitation vector and a residual signal, wherein said residual signal is said first difference signal corresponding to said optimal adaptive codebook excitation vector; and, a fixed codebook searcher for:

sequentially reading fixed codebook excitation vectors from said fixed codebook, producing second synthetic speech signals from said read fixed codebook excitation vectors, subtracting each of said second synthetic speech signals from said residual signal to produce corresponding second difference signals, and comparing said second difference signals to determine said optimal fixed codebook excitation vector.

21. The encoder of claim 19, wherein said search processor combines said optimal adaptive codebook excitation vector and said optimal fixed codebook excitation vector to produce said total excitation vector.

22. The encoder of claim 19, wherein said input signal comprises signal frames, which are partitioned into subframes, and wherein said voicing measure includes:

an average pitch prediction gain determiner for determining an average pitch prediction gain for a signal frame of said input signal from said total excitation vector and said adaptive codebook excitation vector determined for each subframe of said signal frame;

an average pitch lag deviation determiner for determining an average adaptive pitch lag deviation for said signal frame from an index of said adaptive codebook determined for each subflame of said signal frame;

an average adaptive codebook gain determiner for determining an average adaptive codebook gain for said signal frame from an adaptive codebook gain for each subframe of said signal frame; and a comparator for comparing said average pitch prediction gain, said average pitch lag deviation and said average adaptive codebook gain with respective threshold values to determine said voicing measure.

23. The encoder of claim 19, wherein said filter modifies said total excitation vector using a nonlinear function.

24. The encoder of claim 19, further comprising a rescaler in communication with the updater for rescaling said modified total excitation vector to maintain an energy level of said modified total excitation vector.

* * * * *